US008206274B2

(12) United States Patent
Svenberg et al.

(10) Patent No.: US 8,206,274 B2
(45) Date of Patent: Jun. 26, 2012

(54) DUMBBELL

(75) Inventors: Tomas Svenberg, Huskvarna (SE); Per Höglund, Jönköping (SE)

(73) Assignee: Personality Gym AB, Huskvarna (SE)

( * ) Notice: Subject to any disclaimer, the term of this patent is extended or adjusted under 35 U.S.C. 154(b) by 0 days.

(21) Appl. No.: 12/907,050

(22) Filed: Oct. 19, 2010

(65) Prior Publication Data

US 2011/0092345 A1 Apr. 21, 2011

(30) Foreign Application Priority Data

Oct. 21, 2009 (SE) ..... 0901363

(51) Int. Cl.
*A63B 21/072* (2006.01)
*A63B 21/075* (2006.01)
*A63B 21/078* (2006.01)

(52) U.S. Cl. ..... 482/107; 482/104; 482/108

(58) Field of Classification Search ..... 482/50, 482/92–94, 97–98, 104, 106–108; D21/662, D21/679–683, 686, 690–691; 211/85.7; *A63B 21/072, 21/075, 21/078*
See application file for complete search history.

(56) References Cited

U.S. PATENT DOCUMENTS 5,346,448 A * 9/1994 Sollo ..... 482/104
6,228,003 B1 5/2001 Hald et al.
6,669,606 B2 * 12/2003 Krull ..... 482/98
7,128,696 B1 * 10/2006 Krull ..... 482/107
2005/0025287 A1 2/2005 Ritt et al.
2006/0025287 A1 2/2006 Chermack
2007/0161474 A1 7/2007 Lippitt
2009/0048079 A1 2/2009 Nalley
2009/0197745 A1 8/2009 Olson
2010/0304938 A1 * 12/2010 Olson ..... 482/107

FOREIGN PATENT DOCUMENTS

WO 2007123461 A1 11/2007

OTHER PUBLICATIONS

International-Type Search Report for corresponding Swedish App. 0901363-2.
International-Type Search Report for corresponding Swedish App. 0901363-2, Date: Mar. 30, 2010.

* cited by examiner

*Primary Examiner* — Oren Ginsberg
(74) *Attorney, Agent, or Firm* — WRB-IP LLP

(57) ABSTRACT

A dumbbell has an optional number of weight discs which stand on end in a stand, and a handle with anchorages. The anchorages and the weight discs have connecting structures which, in the axial direction, interconnect the anchorages with a neighboring weigh disc or neighboring weight discs, respectively. On the other hand, the connecting structures permit movement transversely of the axial direction. The weight discs display locking structures, which, in the activated state in directions transversely of the axial direction, prevent mutual movements between the weight discs and the anchorages. The locking structures have locking bodies which are movable so that their directions of movement have an axial component and which are disposed at the peripheral regions of the weight discs, and also are insertable in corresponding recesses in a neighboring weight disc or an anchorage. The locking bodies are operable by an operating arrangement located inside the peripheral contour of the weight discs.

16 Claims, 8 Drawing Sheets

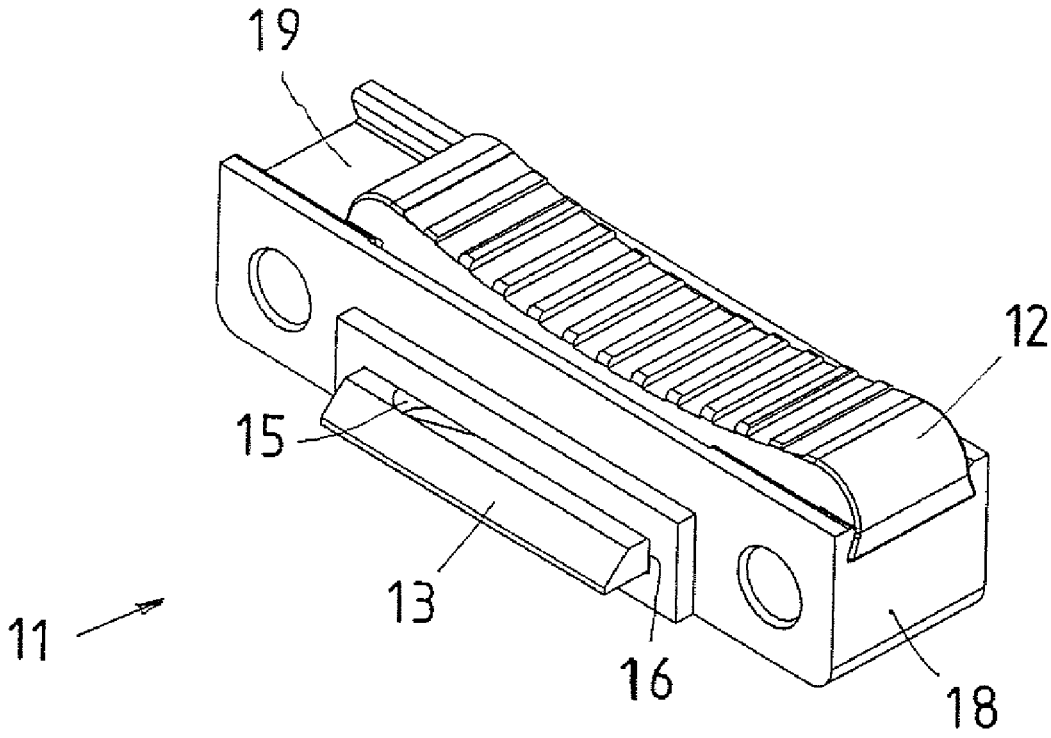
Fig 4
Fig 5
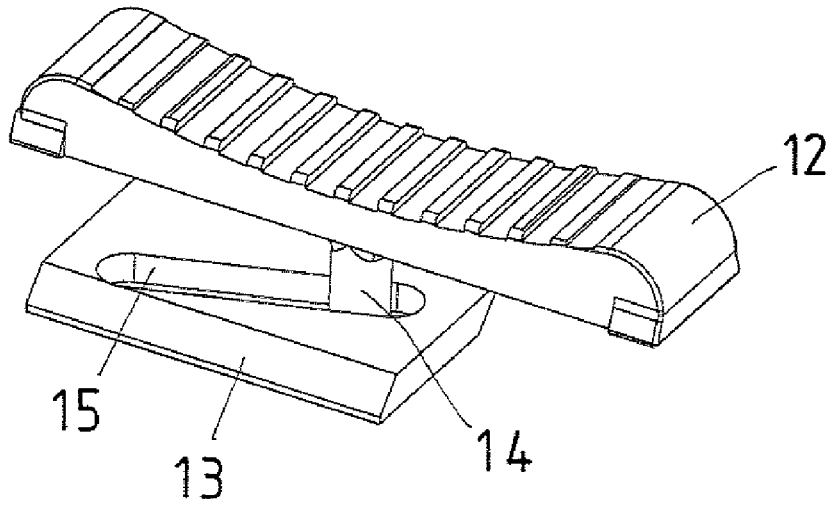

DUMBBELL

BACKGROUND AND SUMMARY

The present invention relates to a dumbbell with an optional number of weight discs and comprising a handle with an anchorage secured at each end, two sets of weight discs standing upright in a stand with the handle between both sets of weight discs, the handle with an optional number of weight discs being liftable out off the stand, connecting means disposed on the anchorages and the weight discs and which, in the axial direction, interconnect the anchorages with a neighboring weight disc or interconnecting neighboring weight discs, respectively, but the connecting means permitting movement transversely of the axial direction, and locking means which, in the activated state in directions transversely of the axial direction prevent mutual movement between the anchorages and neighboring weight discs and between neighboring weight discs, respectively.

A dumbbell of this type is previously known from U.S. Pat. No. 7,588,520. The weight discs and the anchorages according to this publication are provided with projections which are radially directed and which have dovetail-shaped cross section. Opposing the projections, the weight discs have correspondingly configured recesses so that, by accommodating one projection in one recess an interconnection in the axial direction may take place between neighboring weight discs and between an anchorage and a neighboring weight disc, respectively.

The dumbbell according to the US patent Specification further displays a locking mechanism which engages with recesses in the projections. The mechanism is complicated and sensitive and extends outside the periphery of the weight discs, for which reason it may be expected that the mechanism would be destroyed if the dumbbell were to be dropped in an uncontrolled manner on a hard substrate.

It is desirable to design the dumbbell described by way of introduction so that the drawbacks inherent in previously known prior art technology are obviated. In particular, it is desirable to realize a dumbbell which, without risk of being destroyed, may be dropped in an uncontrolled manner also against a hard substrate. It is also desirable to design a dumbbell so that the interconnection between anchorage and weight discs and between neighboring weight discs, respectively, will be reliable and without play. Finally, it is desirable to realize a dumbbell which is simple and economical in manufacture.

According to an aspect of the present invention, a dumbbell described by way of introduction is characterized in that the locking means comprise locking bodies which are movable so that their directions of movement include an axial component of movement, and which are insertable in corresponding recesses on a neighboring weight disc or an anchorage and that the locking bodies are operable under the action of operating means which are located inside the peripheral contour of the weight discs and the anchorages.

BRIEF DESCRIPTION OF THE ACCOMPANYING DRAWINGS

The present invention will now be described in greater detail hereinbelow, with reference to the accompanying Drawings. In the accompanying Drawings:

FIG. 4 shows a locking means for interconnecting neighboring weight discs or a weight disc and an anchorage, respectively;

FIG. 5 shows parts included in the locking means;

DETAILED DESCRIPTION

Figure 1:
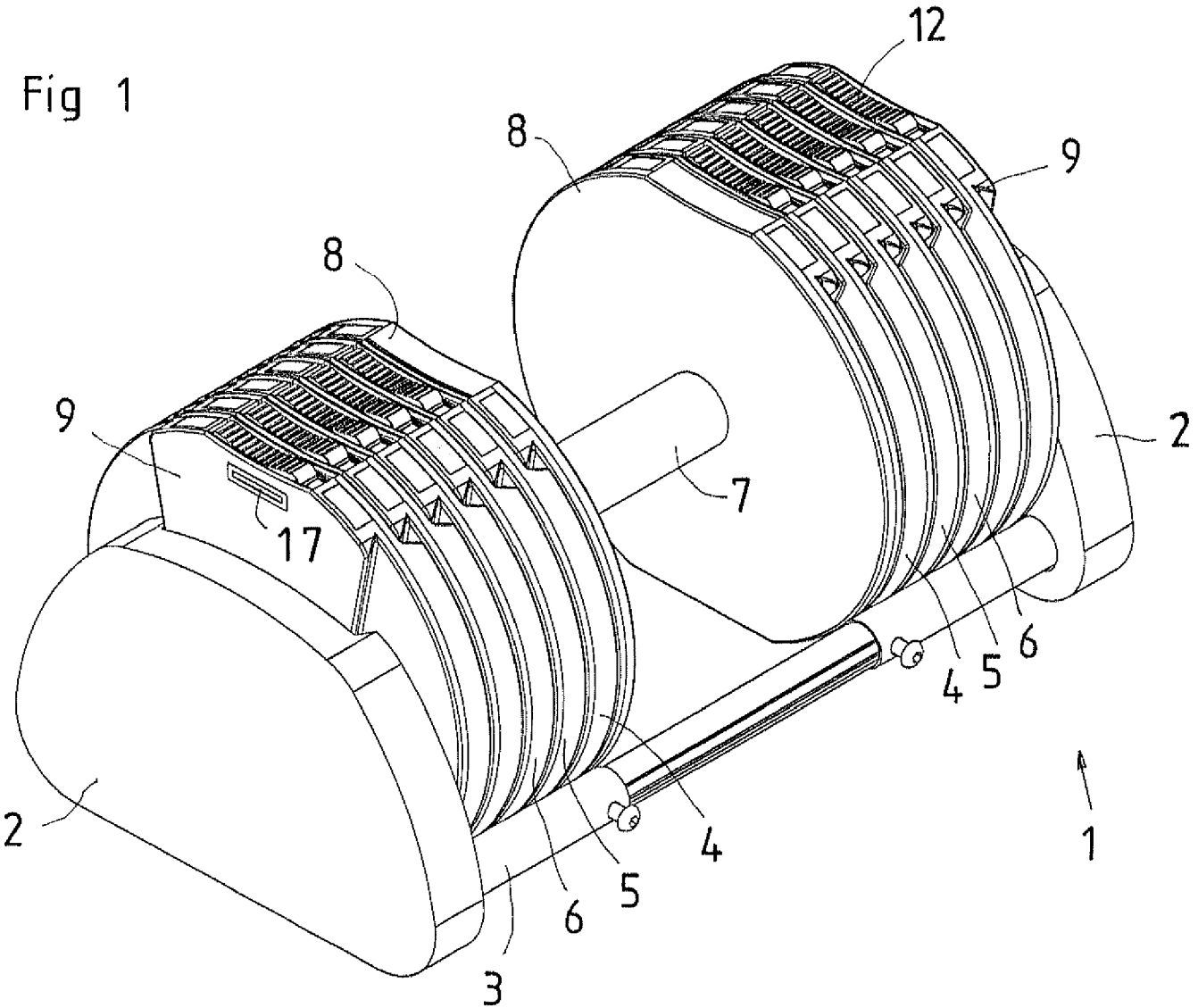
FIG. 1 is a perspective view of a dumbbell in a first embodiment of the present invention.

The dumbbell according to FIG. 1 is disposed in a stand 1 which, at opposing ends, has end pieces 2. The end pieces 2 are interconnected with interconnecting portions 3 of adjustable or fixed lengths in the form of telescopic devices or fixed tubes or rods. In that case when the connecting portions 3 are of adjustable length, the stand 1 may instead be adapted in size to a specific number of weight discs 4, 5 and 6. In FIG. 1, the weight discs are shown standing upright in the stand 1 and, more precisely, resting on the two connection portions 3.

The dumbbell according to FIG. 1 further includes a handle 7 with an anchorage 8 in each end.

Both the anchorages 8 and the weight discs 4-6 are provided with connecting means in the form of projections 9 fitting in corresponding recesses 10 on a neighboring weight disc. The projections 9 and the recesses 10 are cuneiform and are suitably symmetric about a vertical line through the center point of the weight disc. The cross sectional configuration of the projections 9 is undercut, for example dovetailed. The same circumstance applies for the recesses 10 whereby one projection may be passed down into a corresponding recess 10 so that two neighboring weight discs will thereby be interconnected with one another principally in the axial direction. By means of a transversely directed displacement, possibly radial, it is possible to separate the weight discs from one another. As will be apparent from FIG. 2, the recesses 10 are closed in their narrowest ends, where there is disposed a transverse arrest surface 26. On insertion of a projection 9 in such a recess 10, the end surface of the projection will come into abutment against this arrest surface 26, whereby a wedging of the projection in the recess is prevented.

The handle 7 of the dumbbell also has, on its anchorages 8, projections corresponding to the projection 9 on the weight discs, as a result of which one weight disc may be connected together with each anchorage 8.

In the stand, both of the sets of weight discs 4-6 are placed in such a manner that the widest ends of the projections 9 and the recesses 10 are turned to face upwards. In order to ensure this, it is suitable that the end pieces 2 also have corresponding connecting means, in the illustrated embodiment recesses which correspond to the recesses 10 of the weight discs.

The design and construction is such that if the handle 7 is lifted, the handle with the anchorages secured thereon will be lifted up alone in that the projections 9 of the anchorages 8 become disengaged from the recesses 10 of the two innermost weight discs 4.

In order to be able to select the number of weight discs 4-6 which is to be lifted up together with the handle 7, there are provided, on the anchorages and the weight discs, locking means which, in the activated state in directions transversely of the axial direction, prevent mutual movements, on the one hand between the anchorages 8 and the innermost weight discs 4 and, on the other hand between neighboring weight discs, for example the weight discs 4 and 5 or 5 and 6. By activation of a selectable number of locking means, it is thus possible to interconnect the anchorages with a selectable number of weight discs so that the total weight of the dumbbell may hereby be gradually adapted.

According to the present invention, the locking means may be activated under the action of springs. In order to interconnect the handle 7 with a given number of weight discs 4-6, it is sufficient to deactivate, i.e. open, one locking means in order for the weight discs located outside the inactivated locking means not to accompany the handle 7 when it is lifted.

In a first embodiment, the locking means are provided with locking devices 11 which are shown in perspective in FIG. 4. The locking devices 11 include a sliding body 12 movable in the peripheral direction of the weight discs 4-6 and a locking body 13 mechanically interconnected with the sliding body in movement transmission fashion. It will be apparent from FIG. 5 that the sliding body 12 has, on its side facing in towards the center of a weight disc, a pin 14 which engages in a groove 15. In such instance, the sliding body is movable in the peripheral direction of a weight disc or an anchorage, while the groove 15 is obliquely inclined in relation to the peripheral direction. As a result of the engagement between the pin 14 and the groove 15, the locking body 13 will thus execute movements with axial or at least almost axial components when the sliding body is reciprocally displaced in the peripheral direction of a weight disc. In one embodiment, the movement is purely axial.

Figure 2:
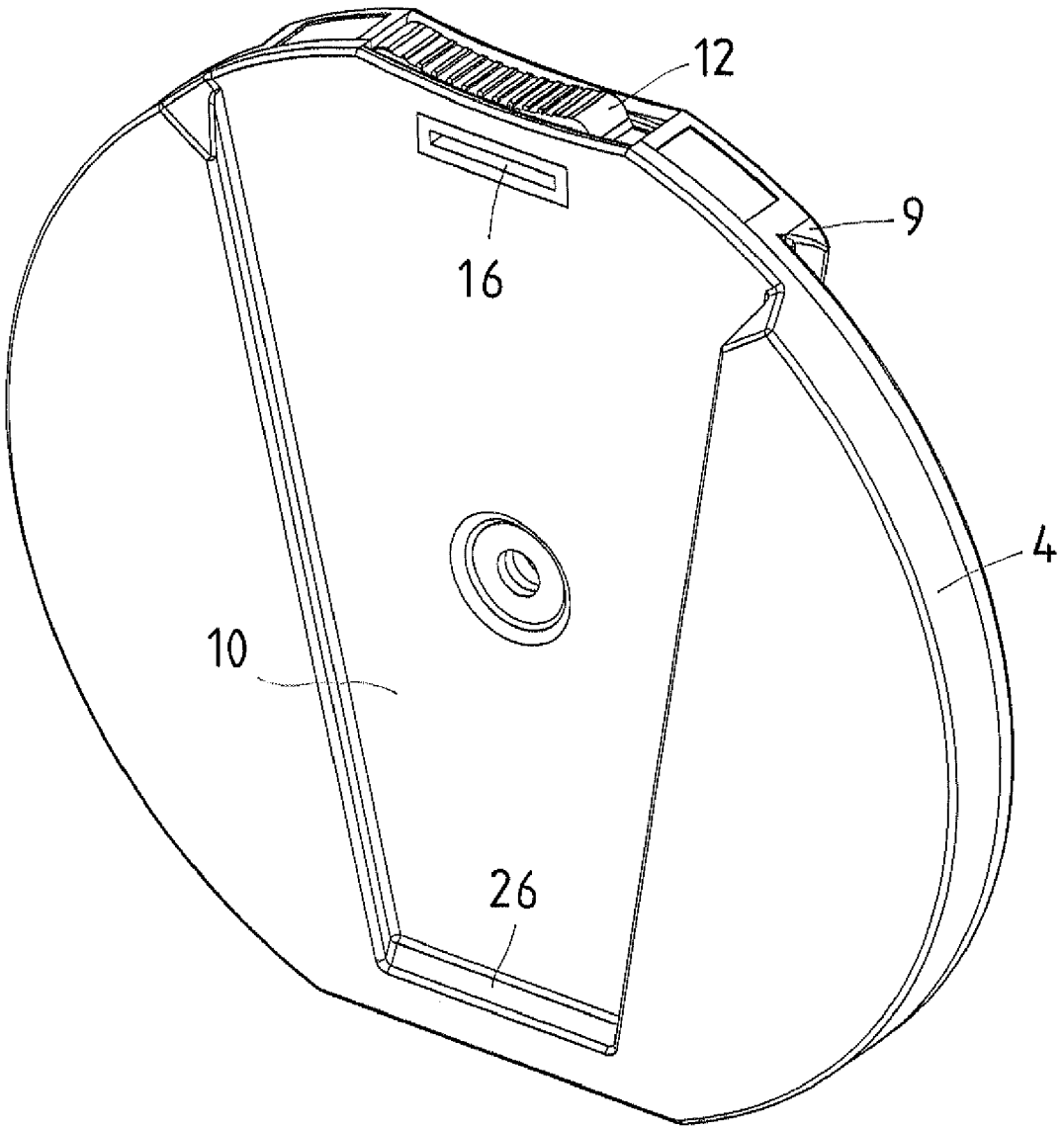
FIG. 2 shows a weight disc included in the dumbbell according to FIG. 1.
Figure 3:
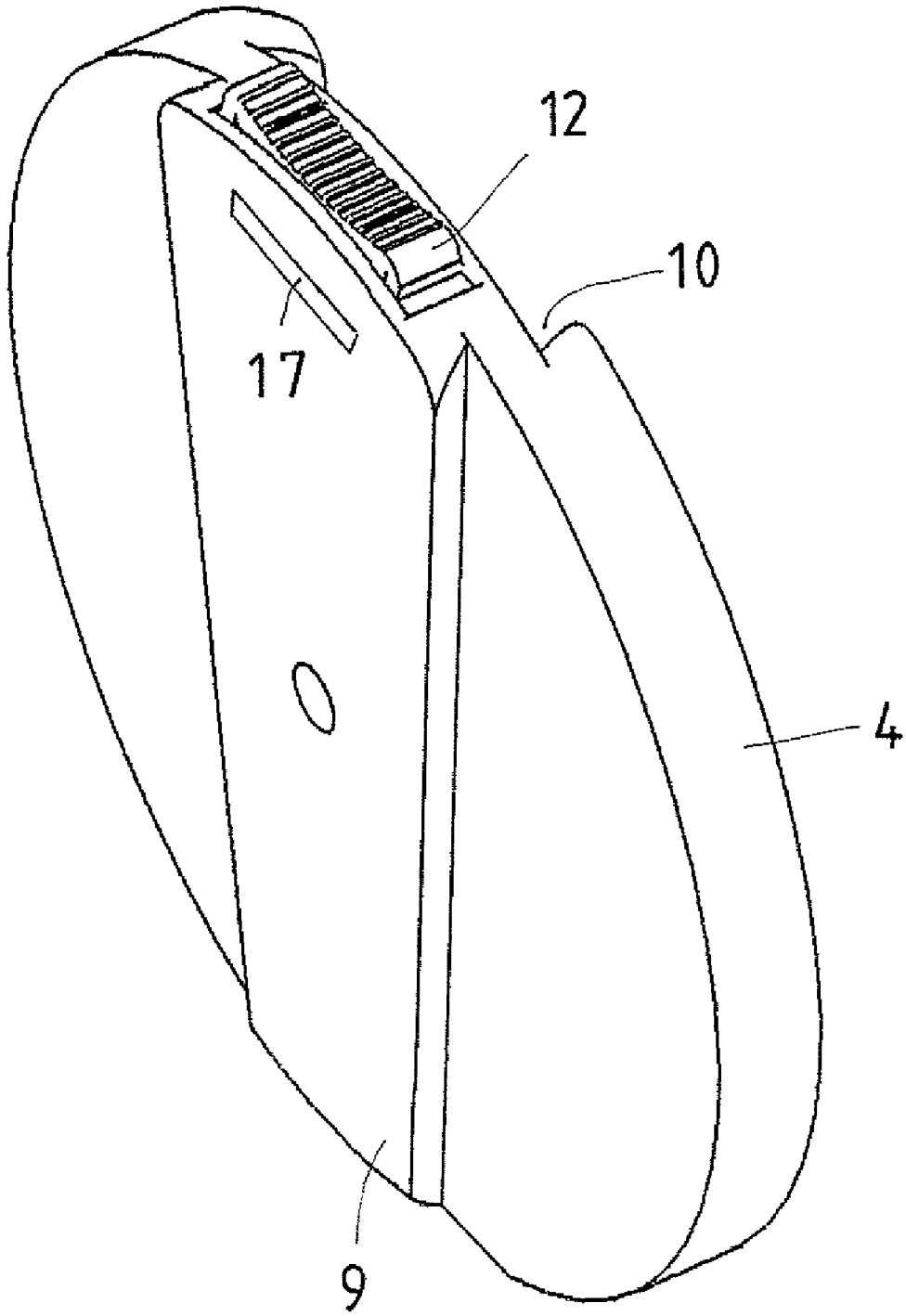
FIG. 3 shows the weight disc according to FIG. 2, but seen from the opposing side.

The locking device 11 is placed in a peripheral region on a weight disc, but in such a manner that it constantly lies inside the peripheral contour of the weight disc. FIG. 2 shows an aperture 16 through which the locking body 13 may project out on activation of the locking device 11. The projecting portion on the locking body 13 then engages in a corresponding recess 17 on either an anchorage 8 or a neighboring weight disc 4-6. When the locking body 13 is thus located in the activated, projecting position, a displacement movement between neighboring weight discs is prevented, and further these are interconnected by means of the engagement between the projections 9 and the recesses 10. FIGS. 1 and 3 show the aperture 17 in which the locking body 13 engages in the activated state.

In the foregoing, one embodiment has been described where the anchorages 8 lack any locking means, for which reason all locking means in this embodiment are placed on the weight discs 4-6. However, the reverse positioning is also conceivable so that the anchorages 8 also display locking means corresponding to the locking devices 11 of the weight discs.

The locking devices 11 according to FIG. 4 are designed with a guide 18 insertable in the weight disc 4-6 and having, on its radially outer side, an undercut groove 19 in which the sliding body 12 is slidable. The profile of the sliding body 12 and the groove 19 is such that only a displacement in the longitudinal direction of the locking body can take place, while on the other hand a removal of the locking body radially outwards, i.e. upwards in FIG. 4, is prevented.

Figure 9:
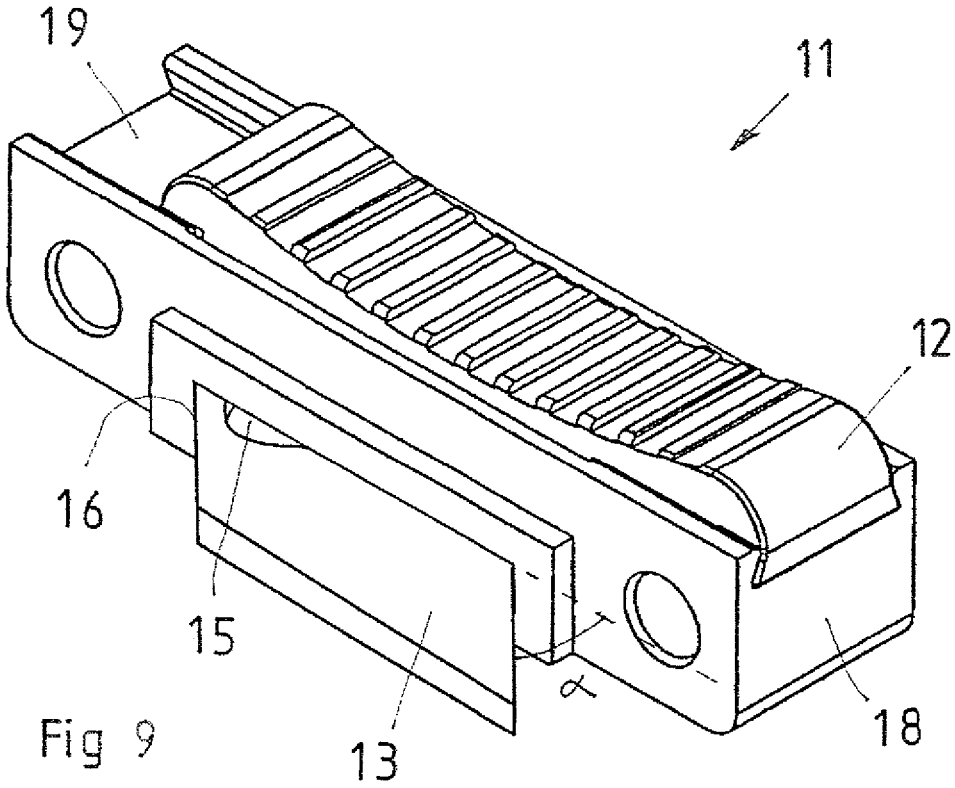
FIG. 9 is a view corresponding to FIG. 4 of a modified embodiment.
Figure 10:
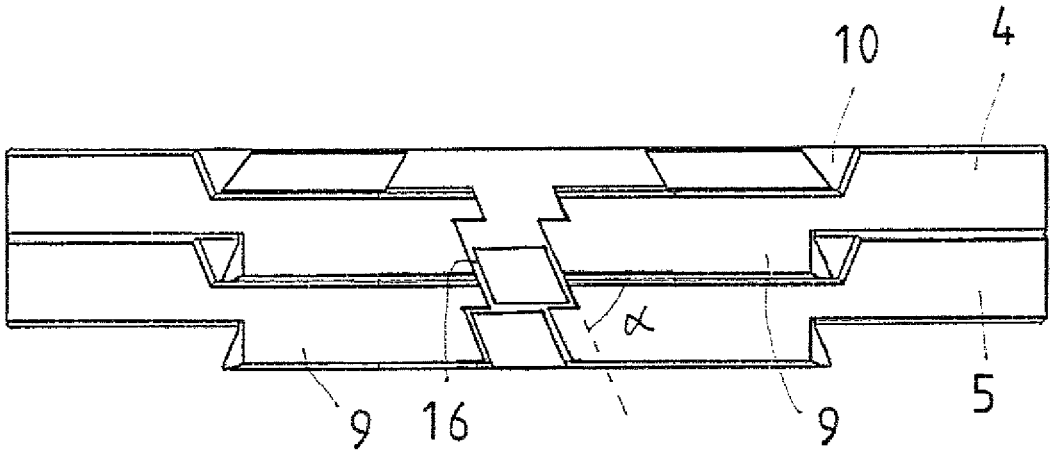
FIG. 10 is a section taken through two interconnected weight discs in the embodiment according to FIG. 9.

FIGS. 9 and 10 show one variation of the embodiment according to FIGS. 1-5, where the direction of movement of the locking body 13 is not axial or almost axial, as is the case according to FIGS. 1-5, but makes an angle $\alpha$ with the plane of extent of a weight disc 4-6. The size of the angle $\alpha$ may vary, but an order of magnitude between 40 and 70° may be appropriate, preferably approx. 45-60°.

The advantage inherent in the embodiment according to FIGS. 9 and 10 is that, by means of the oblique direction of the locking body 13, this will reduce the play in the axial direction which must unavoidably exist between two interconnected weight discs 4-6, since the minor end of a projection 9 must bottom out against the arrest surface 26 in a recess 10 on an adjacent weight disc in order to prevent excessively hard wedging together of two weight discs.

Figure 6:
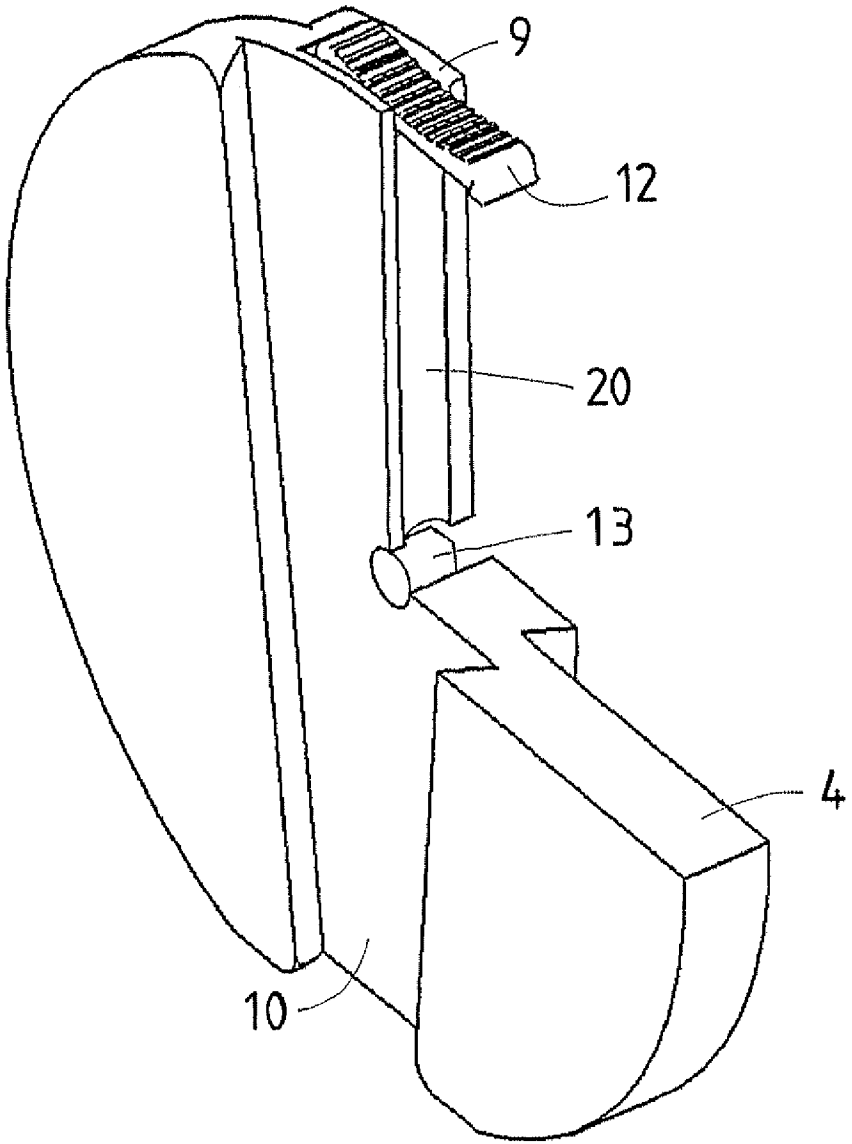
FIG. 6 is a partly cut-away view of a weight disc in a modified embodiment of the present invention.

FIG. 6 shows a modified embodiment of a weight disc 4, where the locking body 13 is placed in the center of the weight disc. The locking body 13 is, in this embodiment, analogous with the above-described locking body, movable substantially in the axial direction.

From the locking body 13, there extends in the radial direction a channel 20 in which a transmission member 21 is longitudinally displaceably accommodated. The transmission member 21 is, with its radial inner end, in engagement with a ramp surface 22 on the radial inner side of the sliding body 12. By displacement of the sliding body 12 in FIG. 7, it is thus possible to displace the transmission member in the vertical direction in the Figure. A spring return may be appropriate in order to cause the transmission member 21 to follow the ramp surface also in the opposite direction of movement.

The lower end of the transmission member 21, the end centrally located in the weight disc, has an obliquely cut surface 23 which is disposed to engage with an end surface of the locking body 13. It will be readably perceived from FIG. 7 that, on a vertical movement of the transmission member 21, the locking body 13 will move in the axial direction, in the Figure in a direction from right to left. This embodiment suitably includes a spring which is disposed to hold the locking body 13 in one of its end positions when there is no actuation by means of the transmission member.

Figure 7:
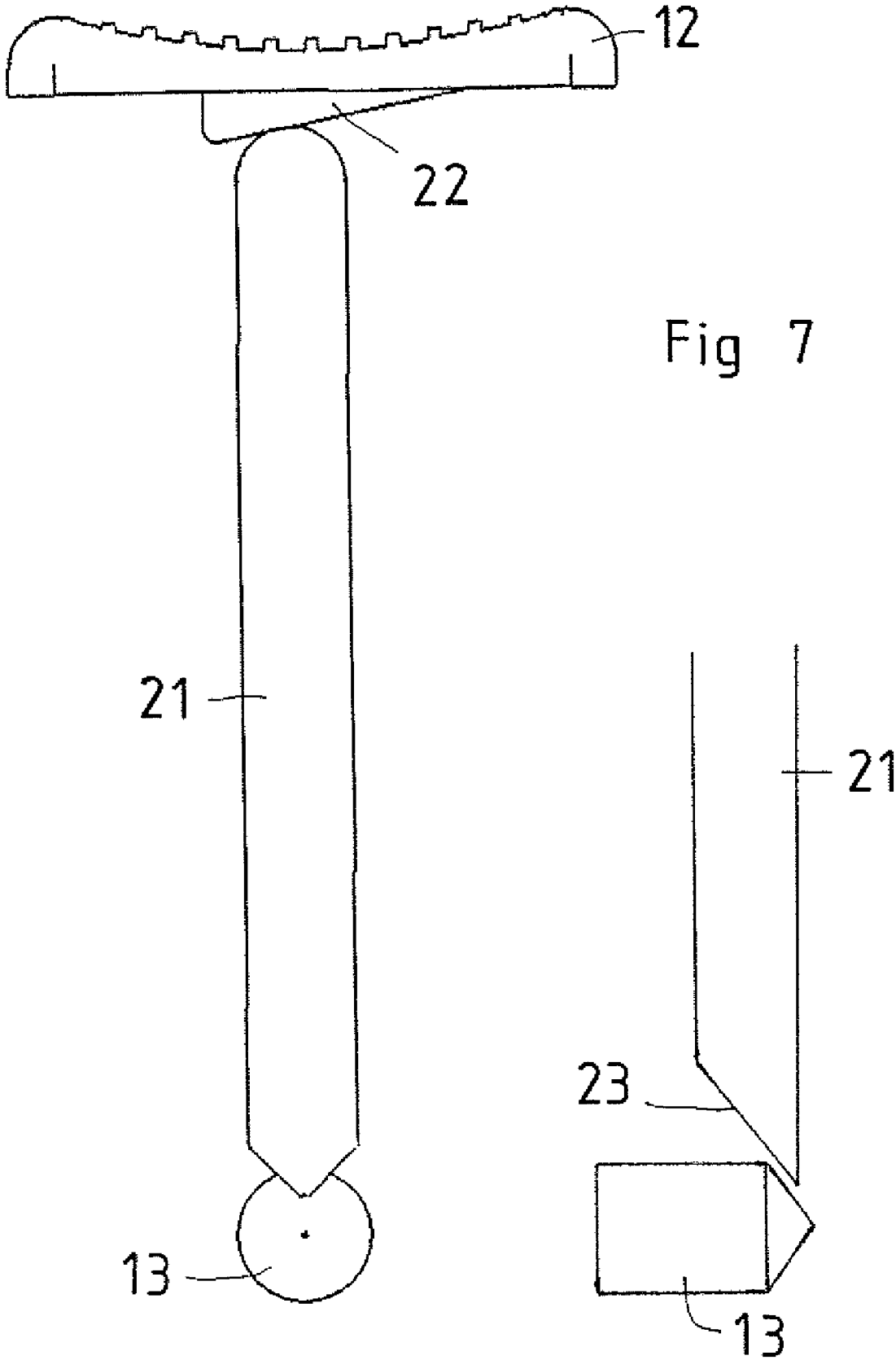
FIG. 7 shows a locking means included in the weight disc according to FIG. 6.
Figure 8:
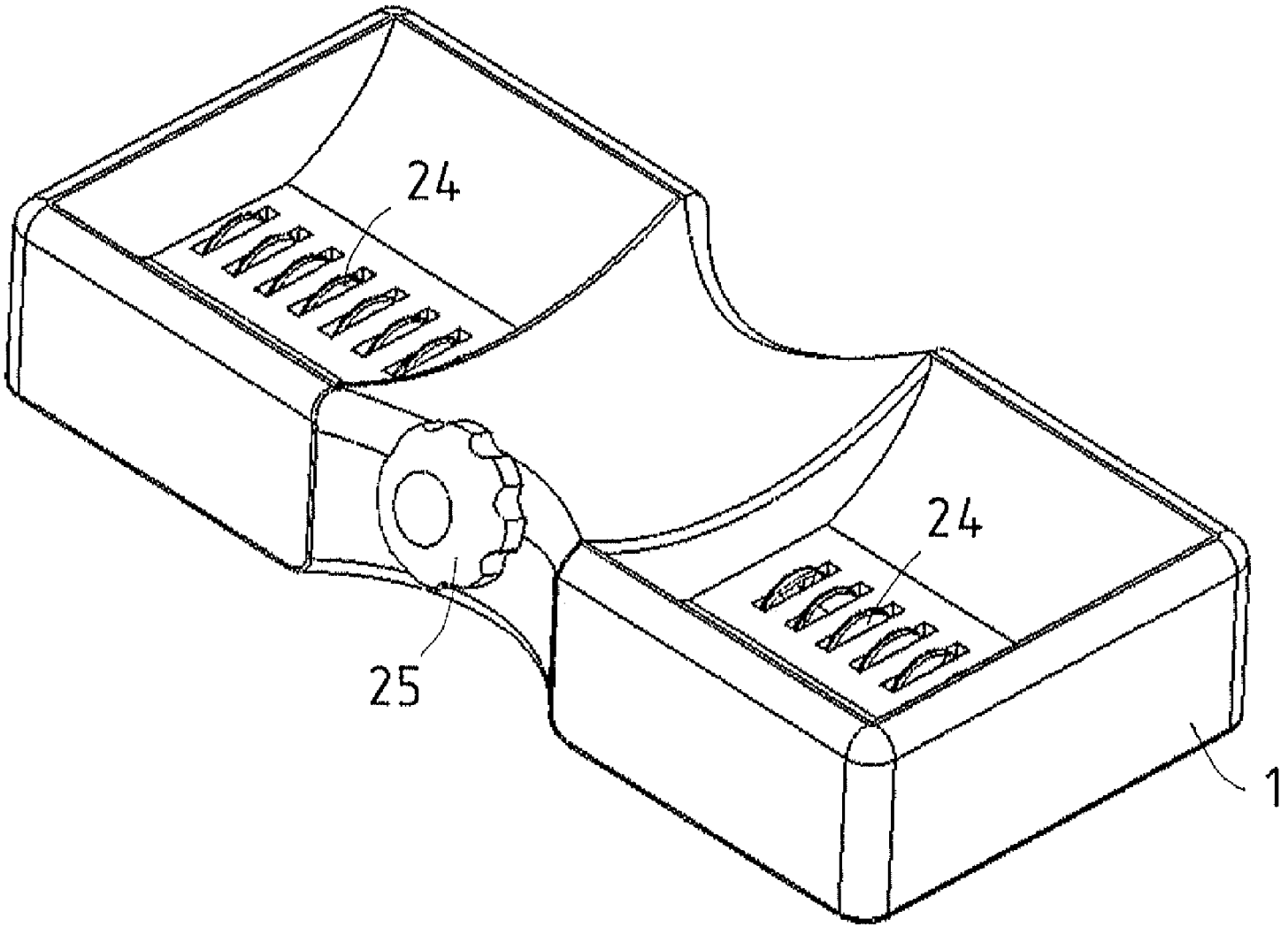
FIG. 8 shows a stand in a modified embodiment of the present invention.

The embodiment illustrated in FIGS. 6 and 7 may also be modified further, for example by eliminating the sliding body 12 and instead of a linear movement in the transmission member 21, this transmission member executes a rotational movement which converted into a linear movement of the locking body 13. This may be achieved for example in that the transmission member 21 displays, in its lower end, hence the end facing towards the locking body 13, an eccentrically positioned element which, on rotation of the transmission member, subjects the locking body 13 to a linear movement. This eccentric element may be an eccentrically positioned pin on the end surface of the transmission member 21, but may also be a fully developed eccentric or merely a planar grinding of a side surface of the lower end portion of the transmission member 21. FIG. 8 illustrates a stand 1 which is designed for central adaptation of that number of weight discs which the dumbbell is to have. Interiorly in the stand, there is disposed a longitudinal shaft, there being on this shaft a number of actuator devices 24, one for each weight disc. These actuator devices extend up through corresponding apertures in the bottom of the stand 1. A knob 25 is disposed on the side surface of the stand 1 and this knob is, by the intermediary of a suitable gear, connected to the shaft provided with actuator devices 24 so that a rotation of the knob 25 will realize a rotation of the shaft provided with the actuator devices 24. The knob 25 may also be disposed directly on the shaft and then be disposed on one of the end pieces 2 of the stand 1.

A weight disc for cooperation with the stand in FIG. 8 has a locking body 13 corresponding to the embodiment according to FIGS. 1-5, but however the locking body has a pin which is disposed to be actuated by the actuator devices 24. In order to realize an axial movement of the locking bodies, the actuator devices have cam surfaces which have a thread-like pitch.

Alternatively, the actuator devices 24 may naturally have circumferential grooves in their periphery, in which event the pins of the locking bodies 13 extend down into and engage in these grooves on the actuator devices. The grooves are also disposed with pitch.

The actuator devices 24 are, in the direction of rotation, offset in relation to one another so that an inner actuator device located most proximal the center of the stand 1 first enters into engagement with the pin on the innermost disc, while thereafter the next actuator device, after a further rotation of the shaft, enters into engagement with the locking body on the weight disc located outside.

It is also conceivable that the embodiment according to FIG. 8 may, as actuator devices 24, have pins disposed on the shaft which are radially, directed and which are designed to enter into engagement with a sliding body 12 of the type which is illustrated in the embodiment according to FIGS. 1-5. Teeth or cogs on the periphery of the actuator devices 24 may also engage with corresponding teeth or cogs on the sliding body.

What is claimed is:

1. A dumbbell with an optional number of weight discs comprising a handle with an anchorage disposed at each end, two sets of weight discs standing on edge in a stand with the handle between both sets of weight discs, the handle, with an optional number of weight discs, being liftable out of the stand, connecting means disposed on the anchorages and the weight discs and, in an axial direction of a longitudinal axis of the handle, interconnecting the anchorages with a neighboring weight disc or interconnecting neighboring weight discs, respectively, the connecting means permitting movements transversely of the axial direction, and locking means which, in an activated state in directions transversely of the axial direction prevents mutual movements between the anchorages and neighboring weight discs and between neighboring weight discs, respectively, wherein the locking means comprises locking bodies which are movable so that their directions of movement contain an axial component of movement, and which are insertable in corresponding recesses on a neighboring weight disc or a neighboring anchorage, the locking bodies being operable under the action of operating means which are located inside a peripheral contour of the weight discs and the anchorages.

2. The dumbbell as claimed in claim 1, wherein the directions of movement of the locking bodies are axial.

3. The dumbbell as claimed in claim 1, wherein the directions of movement of the locking bodies make an angle $\alpha$ with a plane of extent of the neighboring weight disc or the neighboring anchorage.

4. The dumbbell as claimed in claim 1, wherein the locking bodies are disposed at peripheral regions of the weight discs.

5. The dumbbell as claimed in claim 1, wherein the locking bodies are disposed in accommodation spaces in the weight discs, while the anchorages have only recesses.

6. The dumbbell as claimed in claim 1, wherein the locking bodies are disposed in accommodation spaces in the anchorages and in the weight discs.

7. The dumbbell as claimed in claim 1, wherein operating means are disposed on the locking bodies and exposed in recesses which are open towards peripheries of the weight discs and where applicable anchorages; and that a number of actuating means are disposed on a shaft rotatably journalled in the stand, the actuating means having cam surfaces with thread-like pitch in order, on rotation, to axially act on the operating means.

8. The dumbbell as claimed in claim 7, wherein the cam surfaces are offset in the direction of rotation of the shaft, whereby, on rotation of the shaft, the locking bodies are acted on two by two in sequence after one another.

9. The dumbbell as claimed in claim 1, wherein the locking bodies are disposed in the center of the weight discs.

10. The dumbbell as claimed in claim 1, wherein the locking bodies are disposed in accommodation spaces in the weight discs, while the anchorages only have recesses.

11. The dumbbell as claimed in claim 1, wherein the locking bodies are disposed in accommodation spaces on the anchorages and in the weight discs.

12. The dumbbell as claimed in claim 1, wherein transmission members extend between the locking bodies and the peripheral regions of the weight discs, where the transmission members are exposed in recesses which are open to peripheries of the weight discs and where applicable the anchorages.

13. The dumbbell as claimed in claim 12, wherein radial outer ends of the transmission members are actuable by a sliding body which is movable in a peripheral direction of the weight discs or the anchorages.

14. The dumbbell as claimed in claim 1, wherein weight discs including the connecting means and the locking means are identical.

15. The dumbbell as claimed in claim 1, wherein the stand is of adjustable length for accommodating a number of weight discs adapted to an adjusted length of the stand.

16. A dumbbell with an optional number of weight discs comprising a handle with an anchorage disposed at each end, two sets of weight discs standing on edge in a stand with the handle between both sets of weight discs, the handle, with an optional number of weight discs, being liftable out of the stand, connecting means disposed on the anchorages and the weight discs and, in an axial direction, interconnecting the anchorages with a neighboring weight disc or interconnecting neighboring weight discs, respectively, the connecting means permitting movements transversely of the axial direction, and locking means which, in an activated state in directions transversely of the axial direction prevents mutual movements between the anchorages and neighboring weight discs and between neighboring weight discs, respectively, wherein the locking means comprises locking bodies which are movable so that their directions of movement contain an axial component of movement, and which are insertable in corresponding recesses on a neighboring weight disc or a neighboring anchorage, the locking bodies being operable under the action of operating means which are located inside a peripheral contour of the weight discs and the anchorages, wherein the locking bodies comprise grooves which are obliquely directed in relation to circumferential directions of the weight discs and the anchorages and the operating means comprises sliding bodies which are accommodated in circumferentially directed recesses in peripheral edges of the weight discs and which are in engagement in the grooves, whereby a circumferentially directed movement of an operating device results in a substantially axial movement of the associated locking body.

* * * * *